US009799423B2

(12) United States Patent
Guo et al.

(10) Patent No.: US 9,799,423 B2
(45) Date of Patent: Oct. 24, 2017

(54) CABLE AND METHOD OF MANUFACTURING THE SAME

(71) Applicant: LITTELFUSE ELECTRONICS (SHANGHAI) CO., LTD.

(72) Inventors: Tao Guo, Shanghai (CN); Wei Zheng, Shanghai (CN); Jianyong Liu, Shanghai (CN)

(73) Assignee: Littelfuse, Inc., Chicago, IL (US)

( * ) Notice: Subject to any disclaimer, the term of this patent is extended or adjusted under 35 U.S.C. 154(b) by 0 days.

(21) Appl. No.: 14/858,055

(22) Filed: Sep. 18, 2015

(65) Prior Publication Data

US 2016/0086689 A1 Mar. 24, 2016

(30) Foreign Application Priority Data

Sep. 18, 2014 (CN) ..... 2014 1 0482381

(51) Int. Cl.

| | |
|---|---|
| ***H01B 7/00*** | (2006.01) |
| ***H01B 13/00*** | (2006.01) |
| ***H01B 13/14*** | (2006.01) |
| ***H01C 7/02*** | (2006.01) |
| ***H01C 1/14*** | (2006.01) |
| ***H01C 1/146*** | (2006.01) |

(52) U.S. Cl.

CPC ..... *H01B 7/0045* (2013.01); *H01B 13/0036* (2013.01); *H01B 13/14* (2013.01); *H01C 1/146* (2013.01); *H01C 1/1406* (2013.01); *H01C 7/02* (2013.01); *H01B 7/0054* (2013.01)

(58) Field of Classification Search

CPC . H05B 3/146; H01B 1/22; H01B 1/24; H01B 13/14

USPC ..... 174/113 R

See application file for complete search history.

(56) References Cited

U.S. PATENT DOCUMENTS

| | | | | |
|---|---|---|---|---|
| 4,200,973 | A * | 5/1980 | Farkas | H01B 1/24 219/549 |
| 4,661,690 | A | 4/1987 | Yamamoto et al. | |
| 5,247,277 | A | 9/1993 | Fang et al. | |
| 6,303,866 | B1 * | 10/2001 | Lagreve | C08L 67/02 174/110 R |
| 2004/0222012 | A1 * | 11/2004 | Wlos | H01B 7/1825 174/128.1 |

FOREIGN PATENT DOCUMENTS

| | | | |
|---|---|---|---|
| CA | 2266560 | A1 | 3/1999 |
| KR | 101219790 | B1 | 1/2013 |

OTHER PUBLICATIONS

Abstract of KR101219790, dated Jan. 2, 2013, 1 page.

* cited by examiner

*Primary Examiner* — Hoa C Nguyen
*Assistant Examiner* — Amol Patel

(57) ABSTRACT

A cable is provided and includes a first conductor, a second conductor, and a PTC material layer. The PTC material layer is directly bonded to and electrically connects the first conductor and the second conductor.

3 Claims, 4 Drawing Sheets

CABLE AND METHOD OF MANUFACTURING THE SAME

CROSS-REFERENCE TO RELATED APPLICATION

This application claims the benefit of the filing date under 35 U.S.C. §119(a)-(d) of Chinese Patent Application No. 201410482381.1 filed on Sep. 18, 2014.

FIELD OF THE INVENTION

The invention relates to a cable and, more particularly, a cable for a circuit protection device.

BACKGROUND

Positive temperature coefficient (PTC) circuit protection devices are well-known in the art. They are typically independent electronic devices that provide over current protection and/or over voltage protection. However, they cannot be used in place of a cable to transmit electric power. Therefore, in the prior art, it is necessary to use a cable that is independent of the PTC circuit protection device to transmit the electric power among various electrical equipment.

In the prior art, a known PTC circuit protection device may be mounted on a circuit board or connected between cables, and it is necessary to reserve space for installation of the PTC circuit protection device and a large number of cables that are arranged in very high dense area. In this case, installation space becomes very tight, and it is difficult to install many independent PTC circuit protection devices. At the same time, since a main body of the PTC circuit protection device has certain rigidity, the cable cannot be bent at the location of the PTC circuit protection device when the PTC circuit protection device is connected between the cables, reducing the cable layout density.

SUMMARY

The invention has been made to overcome or alleviate at least one aspect of the above mentioned disadvantages.

Accordingly, a cable is provided and includes a first conductor, a second conductor, and a PTC material layer. The PTC material layer is directly bonded to and electrically connects the first conductor and the second conductor.

BRIEF DESCRIPTION OF THE DRAWINGS

The above and other features of the invention will become more apparent by describing in detail exemplary embodiments thereof with reference to the accompanying drawings, in which.

DETAILED DESCRIPTION OF THE EMBODIMENT(S)

Figure 1:
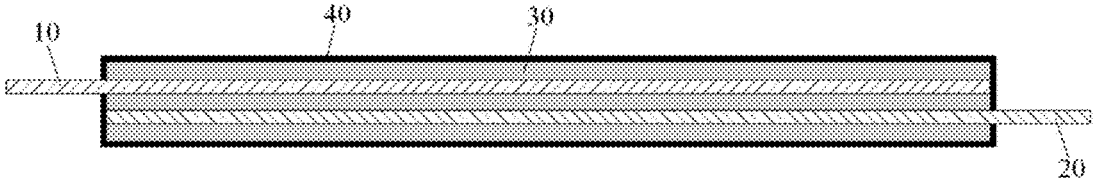
FIG. 1 is a longitudinal cross section view of a cable according to the invention.

Exemplary embodiments of the present disclosure will be described hereinafter in detail with reference to the attached drawings, wherein the like reference numerals refer to the like elements. The present disclosure may, however, be embodied in many different forms and should not be construed as being limited to the embodiment set forth herein; rather, these embodiments are provided so that the present disclosure will be thorough and complete, and will fully convey the concept of the disclosure to those skilled in the art.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Figure 2:
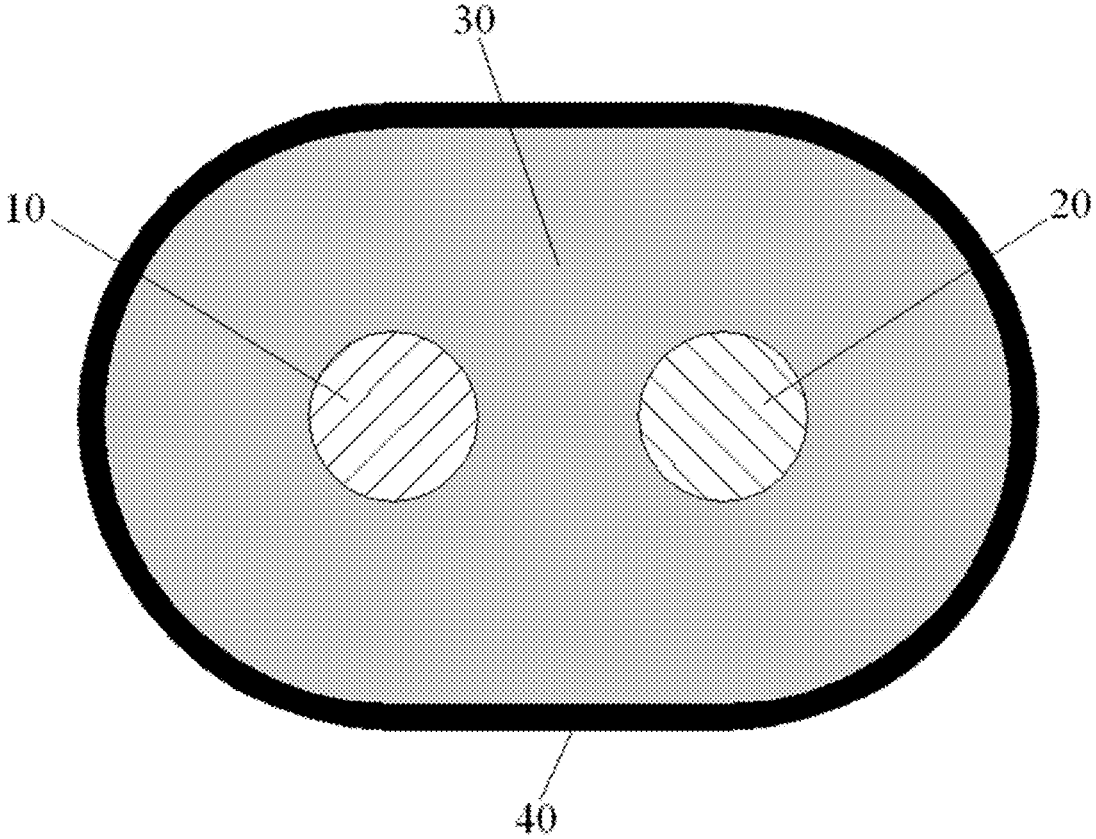
FIG. 2 is a lateral cross section view of the cable of FIG. 1.

As shown in FIGS. 1 and 2, in an exemplary embodiment of the invention, a cable is provided and generally includes a first conductor 10, a second conductor 20 and a PTC material layer 30.

As shown in FIGS. 1 and 2, in the shown embodiment, the PTC material layer 30 is directly bonded to the first conductor 10 and the second conductor 20. The first conductor 10 and the second conductor 20 are separated from each other and electrically connected using the PCT material layer 30, so that a current is able to flow from the first conductor 10 second conductor 20 to the second conductor 20 through the PCT material layer 30.

In an exemplary embodiment of the invention, there is also provided a load circuit having the cable shown in FIGS. 1 and 2. The cable is connected in series on the load circuit to transmit electric power to various electrical equipment (not shown) on the load circuit and provide over current protection for the various electrical equipment.

In the shown embodiments, one of the first conductor 10 and the second conductor 20 of the cable is used as a positive electrode and the other is used as a negative electrode. For example, the first conductor 10 of the cable is electrically connected to an electrode (for example, a negative electrode) of a first electrical equipment on the load circuit; the second conductor 20 of the cable is electrically connected to an electrode (for example, a positive electrode) of a second electrical equipment on the load circuit. In this way, the negative electrode of the first electrical equipment is electrically connected to the positive electrode of the second electrical equipment using the cable shown in FIGS. 1 and 2, that is, the first electrical equipment and the second electrical equipment are electrically connected in series by means of the cable shown in FIGS. 1 and 2. In this case, in normal use of the load circuit, the current is transmitted between the first conductor 10 and the second conductor 20.

On one hand, the PTC material layer 30 has very small resistance in low temperatures, and it may allow a normal current to pass there through. Thereby, in the normal use, the PTC material layer 30 is in a condition of low temperatures and small resistance, and the normal current may flow between the first and second conductors 10, 20 through the PTC material layer 30, so that the electrical equipment connected with each other by means of the cable may work normally.

On the other hand, the PTC material layer 30 has very large resistance in high temperatures and limits a current to pass there through. Thereby, when a high current flows through the first conductor 10, the second conductor 20 and the PTC material layer 30, the temperature and the resistance of the PTC material layer 30 are rapidly increased, so that the current through the first and second conductors 10, 20 is rapidly decreased below an allowed current value, even decreased to zero.

Therefore, in the embodiments of the invention, the cable according to the invention not only has a function of power transmission, but also has functions of over current, over voltage and over thermal protection. Thereby, it may effectively prevent the cables, as well as various electrical equipment connected with the cables, from being burned off due to over current or over heat.

Referring to FIG. 3 again, in the shown embodiment, the first conductor 10 and the second conductor 20 both are enclosed inside the PTC material layer 30. That is, the PTC material layer 30 is clad on the first conductor 10 and the second conductor 20.

In an embodiment of the invention, the PTC material layer 30 may be formed on the first conductor 10 and the second conductor 20 in a manner of extrusion molding.

As shown in FIGS. 1 and 2, in an embodiment of the invention, the cable may further include an outer insulation layer 40 clad on the PTC material layer 30. The outer insulation layer 40 may be formed on the PTC material layer 30 in a manner of extrusion molding.

In an embodiment of the invention, the cable may have round, oval, square, 8-shaped or any other suitable shaped cross section.

In the embodiment shown in FIGS. 1 and 2, the cable includes only a pair of conductors 10, 20. But the invention is not limited to this, the cable may comprise a plurality of pairs of conductors.

Hereafter, it will describe in detail a method of manufacturing the cable according to the first embodiment with reference to FIGS. 1 and 2.

In an embodiment of the invention, there is provided a method of manufacturing the cable shown in FIGS. 1 and 2, generally comprising step of extruding molten PTC material on a first conductor 10 and a second conductor 20 at the same time by an extruder, so as to form a PTC material layer 30 clad on the first conductor 10 and the second conductor 20.

The above method may further comprise step of: forming an outer insulation layer 40 on the PTC material layer 30. For instance, the outer insulation layer 40 may be formed by extruding molten insulation material on the PTC material layer 30 by an extruder.

Figure 3:
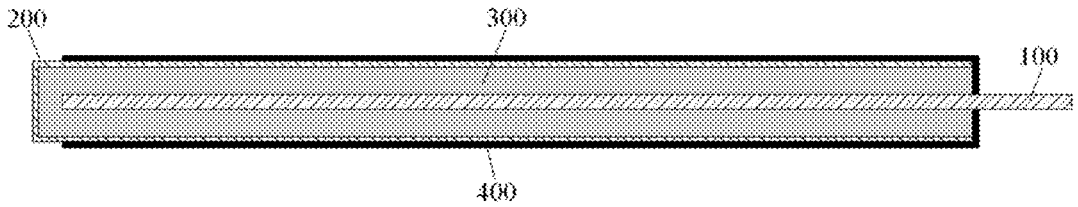
FIG. 3 is a longitudinal cross section view of another cable according to the invention.
Figure 4:
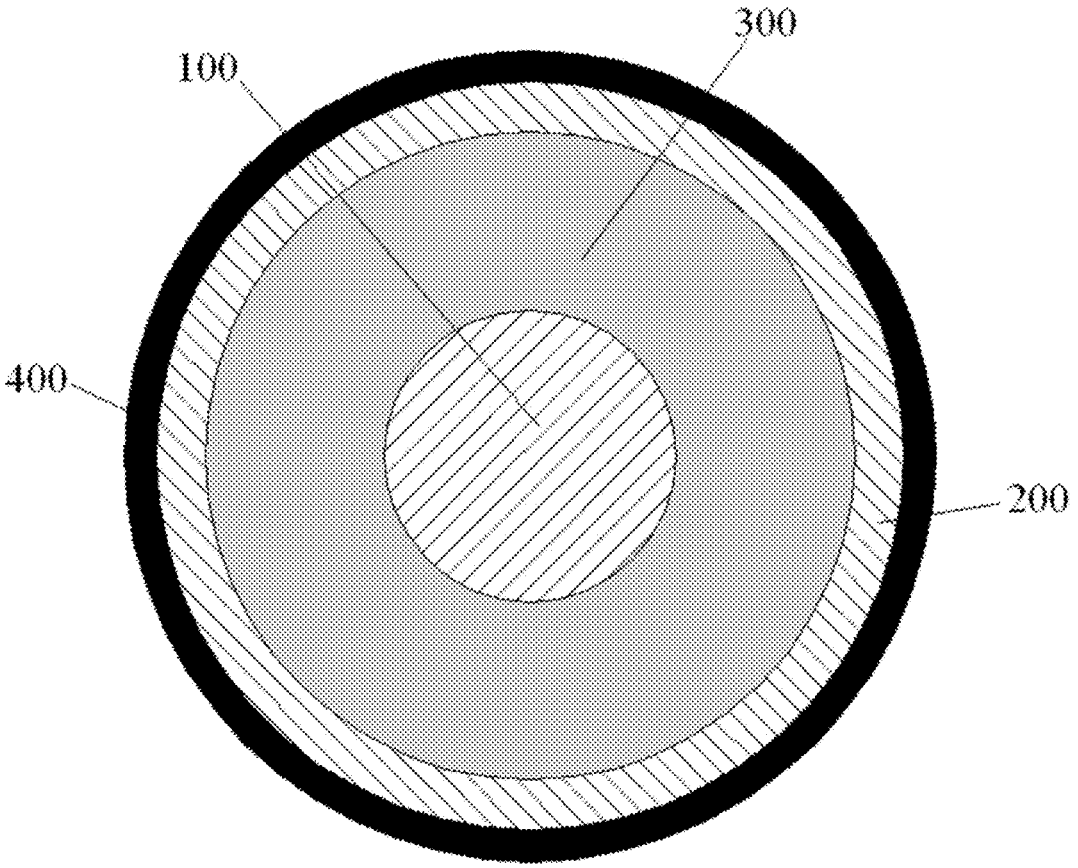
FIG. 4 is a lateral cross section of the cable of FIG. 3.

As shown in FIGS. 3 and 4, in an exemplary embodiment of the invention, another cable according to the invention is shown and generally includes a first conductor 100, a second conductor 200 and a PTC material layer 300.

As shown in FIGS. 3 and 4, in the shown embodiment, the PTC material layer 300 is directly bonded to the first conductor 100 and the second conductor 200. More specifically, the first conductor 100 is enclosed inside the PTC material layer 300. That is, the PTC material layer 300 is clad on the first conductor 100. The second conductor 200 is configured to be a conductive layer clad on the PTC material layer 300. The first conductor 100 and the second conductor 200 are separated from each other and electrically connected via the PCT material layer 300, so that a current is able to flow from the first conductor 100 to the second conductor 200 through the PCT material layer 300.

In an exemplary embodiment of the invention, there is also provided a load circuit having the cable shown in FIGS. 3 and 4. The cable is connected in series on the load circuit, transmits electric power to various electrical equipment (not shown) on the load circuit, and provides over current protection for the various electrical equipment.

In the shown embodiments, one of the first conductor 100 and the second conductor 200 of the cable is used as a positive electrode and the other is used as a negative electrode. For example, the first conductor 100 of the cable is electrically connected to an electrode (for example, a negative electrode) of a first equipment on the load circuit; the second conductor 200 of the cable is electrically connected to an electrode (for example, a positive electrode) of a second electrical equipment on the load circuit. In this way, the negative electrode of the first electrical equipment is electrically connected to the positive electrode of the second electrical equipment via the cable shown in FIGS. 3 and 4, that is, the first electrical equipment and the second electrical equipment are electrically connected in series by means of the cable shown in FIGS. 3 and 4. In this case, in normal use of the load circuit, the current flows into the first electrical equipment from the first conductor 100 and flows out of the second equipment from the second conductor 200.

On one hand, the PTC material layer 300 has very small resistance in low temperature, and it may allow a normal current to pass there through. Thereby, in the normal use, the PTC material layer 300 is in a condition of low temperature and small resistance, and the normal current may flow between the first and second conductors 100, 200 through the PTC material layer 300, so that the electrical equipment connected with each other by means of the cable may work normally.

On the other hand, the PTC material layer 300 has very large resistance in high temperature, and limits a current to pass there through. Thereby, when a high current flows through the first conductor 100, the second conductor 200 and the PTC material layer 300, the temperature and the resistance of the PTC material layer 300 are rapidly increased, so that the current through the first and second conductors 100, 200 may be rapidly decreased below an allowed current value, even decreased to zero.

Therefore, in the embodiments of the invention, the cable not only has a function of power transmission, but may function as ab over current, over voltage and over thermal protection device. Thereby, it may effectively prevent the cables, as well as various electrical equipment connected with the cables, from being burned off due to over current or over heat.

In an embodiment of the invention, the PTC material layer 300 may be formed on the first conductor 100 in a manner of extrusion molding, and the second conductor (conductive layer) 200 may be formed on the PTC material layer 300 by means of electroplating.

As shown in FIGS. 3 and 4, in an embodiment of the invention, the cable may further include an outer insulation layer 400 clad on the second conductor 200. The outer insulation layer 400 may be formed on the second conductor 200 in a manner of extrusion molding.

In an embodiment of the invention, the cable may have round, oval, square, 8-shaped or any other suitable shaped cross section.

In the embodiment shown in FIGS. 3 and 4, the cable includes only a pair of conductors 100, 200. But the invention is not limited to this, but the cable may also include a plurality of pairs of conductors.

Hereafter, it will describe in detail a method of manufacturing the cable according to the second embodiment with reference to FIGS. 3 and 4.

In an embodiment of the invention, there is provided a method of manufacturing the cable shown in FIGS. 3 and 4, generally comprising steps of extruding molten PTC material on a first conductor 100 by an extruder, so as to form a PTC material layer 300 clad on the first conductor 100, and forming a conductive layer, served as a second conductor 200, on the PTC material layer 300.

The above method may further include a step of forming an outer insulation layer 400 on the second conductor (conductive layer) 200. For instance, the outer insulation layer 400 may be formed by extruding molten insulation material on the PTC material layer 300 by an extruder.

Figure 5:
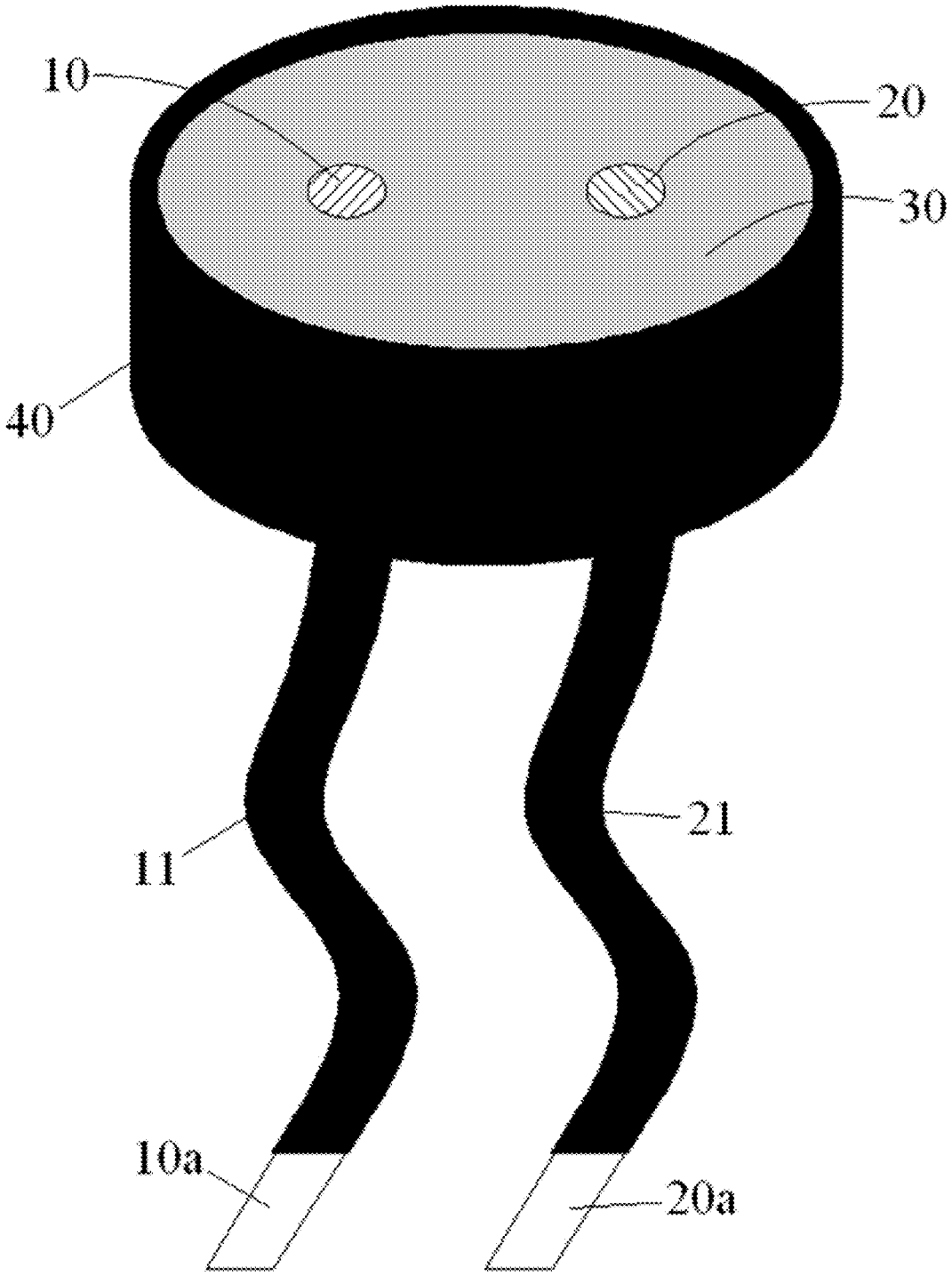
FIG. 5 is a schematic diagram of a first circuit protection device with of a cable according to the invention.

Now with reference to FIG. 5, a circuit protection device having a cable of FIGS. 1 and 2 is shown.

As shown in FIG. 5, in an embodiment of the invention, there is also disclosed a method of manufacturing a circuit protection device. The method mainly includes steps of:

S101: providing the cable as shown in FIGS. 1 and 2;

S102: cutting the cable into cable segments each having a predetermined length; and S103: removing a portion of the PTC material layer 30 from each of the cable segments, so that the first conductor 10 and the second conductor 20 of the cable segment are partly exposed.

In another embodiment, if the cable includes an outer insulation layer 40, the outer insulation layer 40 may be partly removed in the step S103 during removing the PTC material layer 30.

In an embodiment of the invention, as shown in FIG. 5, the first conductor 10 and the second conductor 20 are flexible wires. The exposed parts of the first conductor 10 and the second conductor 20 of the cable segment are used as a first pin 10*a* and a second pin 20*a* of the circuit protection device, respectively. The first pin 10*a* and the second pin 20*a* of the circuit protection device may be electrically connected to a negative (positive) electrode of first electrical equipment and a positive (negative) electrode of second electrical equipment. That is, the first electrical equipment and the second electrical equipment may be connected in series with the circuit protection device.

As shown in FIG. 5, in the shown embodiment, since first conductor 10 and the second conductor 20 are flexible wires, and since the exposed pins 10*a*, 20*a* of the first conductor 10 and the second conductor 20 of the cable segment are relative long, a first insulation protection tube 11 and a second insulation protection tube 21 are formed on the first pin 10*a* and the second pin 20*a*, respectively, so as to protect the flexible exposed pins 10*a*, 20*a* with relative large length.

Figure 6:
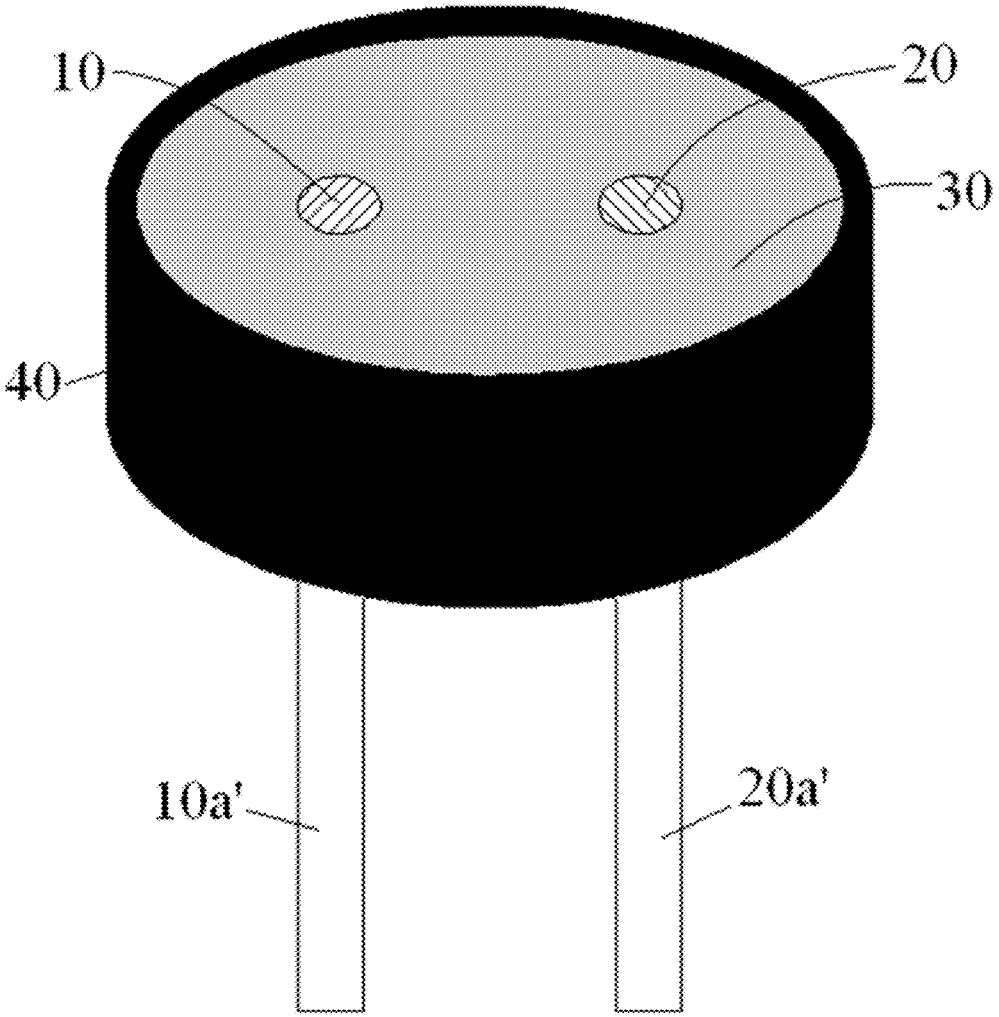
FIG. 6 is a schematic diagram of a second circuit protection device made of a cable according to the invention.

With reference to FIG. 6, another circuit protection device is provided and includes the cable of FIGS. 1 and 2.

As shown in FIG. 6, in an embodiment of the invention, there is also disclosed a method of manufacturing a circuit protection device. The method mainly includes steps of:

S201: providing the cable as shown in FIGS. 1 and 2;

S202: cutting the cable into cable segments each having a predetermined length; and S203: removing a portion of the PTC material layer 30 from each of the cable segments, so that the first conductor 10 and the second conductor 20 of the cable segment are partly exposed.

In another embodiment, if the cable includes an outer insulation layer 40, the outer insulation layer 40 may be partly removed in the step S203 during removing the PTC material layer 30.

In an embodiment of the invention, as shown in FIG. 6, the first conductor 10 and the second conductor 20 are hard wires. The exposed parts of the first conductor 10 and the second conductor 20 of the cable segment are used as a first pin 10*a* and a second pin 20*a* of the circuit protection device, respectively. The first pin 10*a* and the second pin 20*a* of the circuit protection device may be electrically connected to a negative (positive) electrode of a first electrical equipment and a positive (negative) electrode of a second electrical equipment. In this way, the first electrical equipment and the second electrical equipment may be connected in series with the circuit protection device.

In some embodiments of the invention, the multi-core cable is made of PPTC (polymer positive temperature coefficient) material and conductors by using the existing traditional cable processing technology. If necessary, an insulation layer may be formed on the PTC material layer. This cable not only has the function of power transmission, but also it may function as an over current, over voltage and over thermal protection device. In this way, the traditional independent circuit protection device and its accessories may be replaced by this cable of the invention, and the installation space for mounting the independent circuit protection device and its accessories may be saved.

Furthermore, in some embodiments of the invention, an independent PTC circuit protection device or an independent PTC temperature sensing device may be made simply by cutting the cable, simplifying the configuration of the PTC circuit protection device, and reducing the cost.

It should be appreciated for those skilled in this art that the above embodiments are intended to be illustrated, and not restrictive. For example, many modifications may be made to the above embodiments by those skilled in this art, and various features described in different embodiments may be freely combined with each other without conflicting in configuration or principle.

Although several exemplary embodiments have been shown and described, it would be appreciated by those skilled in the art that various changes or modifications may be made in these embodiments without departing from the principles and spirit of the disclosure, the scope of which is defined in the claims and their equivalents.

As used herein, an element recited in the singular and proceeded with the word "a" or "an" should be understood as not excluding plural of said elements or steps, unless such exclusion is explicitly stated. Furthermore, references to "one embodiment" of the invention are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

What is claimed is:

1. A method of manufacturing a circuit protection device, comprising steps of:

forming a cable, comprising steps of:

providing a first conductor;

providing a second conductor separate from the first conductor; and extruding a positive temperature coefficient (PTC) material layer on the first conductor and the second conductor;

cutting a segment of the cable, the segment having a first end and a second end; and removing a portion of the PTC material layer from the second end to expose a portion of the first conductor and a portion of the second conductor, wherein the exposed portion of the first conductor, the exposed portion of the second conductor, and the PTC material layer are electrically in series with one another.

2. The method according to claim 1, wherein the first conductor and the second conductor are electrically connected to each other using the PTC material layer.

3. The method according to claim 1, comprising a further step of forming an outer insulation layer on the PTC material layer.

* * * * *